US010561890B2

(12) United States Patent
Michaels

(10) Patent No.: US 10,561,890 B2
(45) Date of Patent: Feb. 18, 2020

(54) EXERCISE APPARATUS, KIT AND METHOD

(71) Applicant: Matthew Michaels, Scotts Valley, CA (US)

(72) Inventor: Matthew Michaels, Scotts Valley, CA (US)

( * ) Notice: Subject to any disclaimer, the term of this patent is extended or adjusted under 35 U.S.C. 154(b) by 221 days.

(21) Appl. No.: 15/514,273

(22) PCT Filed: Jul. 21, 2015

(86) PCT No.: PCT/IB2015/001954
§ 371 (c)(1),
(2) Date: Mar. 24, 2017

(87) PCT Pub. No.: WO2016/046632
PCT Pub. Date: Mar. 31, 2016

(65) Prior Publication Data

US 2018/0021625 A1 Jan. 25, 2018

Related U.S. Application Data

(60) Provisional application No. 62/118,451, filed on Feb. 19, 2015, provisional application No. 62/102,343, (Continued)

(51) Int. Cl.
*A63B 22/00* (2006.01)
*A63B 1/00* (2006.01)
(Continued)

(52) U.S. Cl.
CPC ..... *A63B 22/0012* (2013.01); *A63B 1/00* (2013.01); *A63B 17/04* (2013.01);
(Continued)

(58) Field of Classification Search
CPC ..... A63B 22/0012; A63B 23/12–1227; A63B 1/00; A63B 23/1209; A63B 23/1218; A63B 1/002
See application file for complete search history.

(56) References Cited

U.S. PATENT DOCUMENTS 5,080,353 A 1/1992 Tench
5,951,449 A 9/1999 Oppriecht
(Continued)

FOREIGN PATENT DOCUMENTS

WO WO 2016/045532 A3 3/2016

OTHER PUBLICATIONS

PCT/IB2015/001954, Jun. 3, 2016, Intl. Search Report.
PCT/IB2015/001954, Jun. 3, 2016, Written Opinion.

*Primary Examiner* — Nyca T Nguyen
(74) *Attorney, Agent, or Firm* — John J. Connors; Connors & Assoc. p.

(57) ABSTRACT

My exercise apparatus comprises a lower body exercise machine, and an overhead upper body exercise device with a horizontally oriented, rigid handlebar connected to an elastic member suspended overhead. The positioning of the apparatus allows the user, while standing and operating the lower body exercise machine and without lifting the user's body up and off the lower body exercise machine, to operate the upper body exercise device. The user grips the handlebar and simultaneously pulls the handlebar towards the user's chest, stretching the elastic member to lengthen the elastic member, placing the elastic member in tension. Then the user slowly releases the tension and allows the elastic member to shorten in length, thus providing upper body and core muscle strengthening. The combination of the upper body exercise device and the lower body exercise machine provide a comprehensive, full body workout. A kit and method are also disclosed.

3 Claims, 19 Drawing Sheets

Related U.S. Application Data filed on Jan. 12, 2015, provisional application No. 62/055,062, filed on Sep. 25, 2014.

(51) Int. Cl.

| | |
|---|---|
| ***A63B 21/055*** | (2006.01) |
| ***A63B 21/068*** | (2006.01) |
| ***A63B 21/00*** | (2006.01) |
| ***A63B 22/02*** | (2006.01) |
| ***A63B 22/04*** | (2006.01) |
| ***A63B 22/06*** | (2006.01) |
| ***A63B 23/035*** | (2006.01) |
| ***A63B 21/16*** | (2006.01) |
| ***A63B 23/12*** | (2006.01) |
| ***A63B 17/04*** | (2006.01) |

(52) U.S. Cl.

CPC .. *A63B 21/00047* (2013.01); *A63B 21/00181* (2013.01); *A63B 21/0552* (2013.01); *A63B 21/0557* (2013.01); *A63B 21/068* (2013.01); *A63B 21/4034* (2015.10); *A63B 21/4035* (2015.10); *A63B 21/4043* (2015.10); *A63B 22/0056* (2013.01); *A63B 22/02* (2013.01); *A63B 22/04* (2013.01); *A63B 22/0605* (2013.01); *A63B 22/0664* (2013.01); *A63B 23/1218* (2013.01); *A63B 23/1227* (2013.01); *A63B 21/169* (2015.10); *A63B 23/03525* (2013.01); *A63B 2022/0074* (2013.01); *A63B 2210/50* (2013.01); *A63B 2225/093* (2013.01)

(56) References Cited

U.S. PATENT DOCUMENTS

| | | | | |
|---|---|---|---|---|
| 6,450,923 | B1 * | 9/2002 | Vatti | A63B 21/00181 482/51 |
| 6,887,190 | B1 | 5/2005 | Azari | |
| 7,833,131 | B2 * | 11/2010 | Rote | A63B 5/11 482/27 |
| 7,918,767 | B1 * | 4/2011 | Wilson | A63B 21/153 482/45 |
| 8,221,295 | B2 | 7/2012 | Wilkins et al. | |
| 9,474,928 | B1 * | 10/2016 | Maresh | A63B 22/02 |
| 2003/0216220 | A1 * | 11/2003 | Rota | A63B 1/00 482/27 |
| 2005/0255971 | A1 * | 11/2005 | Solomon | A61H 1/0229 482/54 |
| 2005/0272567 | A1 * | 12/2005 | Ditolla | A63B 22/0012 482/62 |
| 2010/0048368 | A1 * | 2/2010 | Donofrio | A63B 1/00 482/130 |
| 2010/0087295 | A1 * | 4/2010 | Crawley, IV | A63B 17/00 482/52 |
| 2010/0267526 | A1 * | 10/2010 | Baschnagel | A63B 21/026 482/86 |
| 2011/0082013 | A1 | 4/2011 | Bastian | |
| 2012/0094815 | A1 * | 4/2012 | Trettin | A63B 9/00 482/143 |
| 2014/0031182 | A1 * | 1/2014 | Donofrio | A63B 21/0442 482/129 |

* cited by examiner

Progression of a Pull-Up in one motion

Progression of Dip Exercise

EXERCISE APPARATUS, KIT AND METHOD

RELATED PATENT APPLICATIONS & INCORPORATION BY REFERENCE

This international application claims the benefit under 35 USC 119(e) of U.S. Provisional Patent Application No. 62/055,062, filed Sep. 25, 2014; U.S. Provisional Patent Application No. 62/102,343, filed Jan. 12, 2015; and U.S. Provisional Patent Application No. 62/118,451, filed Feb. 19, 2015. All these related provisional applications are incorporated herein by reference and made a part of this application. Moreover, any and all U.S. patents, U.S. patent applications, and other documents, hard copy or electronic, cited or referred to in this application are incorporated herein by reference and made a part of this application.

BACKGROUND

In today's fast paced environment many people have discovered the therapeutic benefits of daily exercising to reduce stress, reduce body fat, stay in shape, and maintain a healthy and active lifestyle. This is currently achieved through various strength-training regimens and equipment designed for both home and commercial gyms.

Currently a demand is driving an industry that generates $4.49 billion in annual sales (circa 2011) for better exercise machines and equipment that achieves faster results and exercises the most muscles while also being easy, comfortable, and fun to use. Other currently desirable qualities also include core muscle strengthening (belly and mid and lower back), low impact to the user's joints, affordable and the smallest spatial footprint possible.

Many excellent exercise machines provide aerobic exercises such as the stationary bike, stair climber, elliptical trainer, arc trainer and treadmill. These machines and exercises only strengthen the lower body muscles with little to no upper body or core muscle strengthening. There are also many strength training machines for the upper body, but they are specific to certain muscle groups and do not provide any aerobic or lower body strengthening or training.

In order to get a full body workout, current workouts require exercising on several machines. This is time prohibitive and cost prohibitive for a home gym and even for commercial gyms, which are constantly striving to provide the best and most 'in demand' exercise equipment that takes up the least amount of space. An all-in-one exercise machine that provides the most efficient exercise for achieving the best workout possible in the least amount of time would provide a significant advantage, and this advantage would be even greater if the machine was also: affordable, easy to use, easy to maintain, and minimal in size and weight, and thus easy to move or store.

These characteristics would give as many people as possible the ability to stay physically fit and healthy, and thus have the best quality and most productive and active lifestyle possible.

SUMMARY

My exercise apparatus is such an all-in-one exercise machine that enables a user to perform my method of cardiovascular exercise and simultaneous muscle strengthening of the lower body, upper body, and core muscles. My method and exercise apparatus transforms traditional single function lower body exercise equipment into a multi-function, total body system that exercises the lower body, upper body and core muscles. Using my method and exercise apparatus, these three muscle groups can be exercised simultaneously or individually at the user's comfort, and this multi-function exercise apparatus is more economical than previous equipment.

My exercise apparatus includes a lower portion for a lower body workout and an upper portion for an upper body workout. The upper portion also gives the user vertical support and the ability to do core strengthening exercises. The user stands on the lower portion, which is a lower body workout device such as a stair-climber, tread mill, stationary bike, elliptical trainer, or arc trainer, and uses this part of my apparatus to conduct a lower body exercise. The upper portion provides vertical stabilization when lower body, upper body and core muscles are exercised simultaneously. My exercise apparatus enables a user to exercise the different muscle groups individually as well.

The upper portion is mounted above the head of the user and includes a handlebar, which has fixed and variable options. When fixed, it is mounted on a rack positioned such that the user, with arms outstretched and extending upward, can grip the handlebar overhead. This position enables the user to perform pull-ups. For the variable option, an elastic member is attached to the handlebar so it can be removed from it's rack-holder and used for strengthening exercises as follows: The user removes the handlebar from the rack-holder and pulls on it; resistance is provided by the stretching of the elastic members. The handlebar is simply returned to the rack when this exercise is finished.

In one embodiment of my exercise apparatus a pair of elastic members are employed. Distal ends of the elastic members are attached in a fixed position to a support structure above the user to suspend the handlebar above the lower body workout device and within the reach of the user. The elastic members can support the user's weight but also allows the user to move the handlebar into any desired overhead non-static position. The same non-static handlebar can, in one motion and without changing an overhanded or underhanded grip, be placed in an overhead rack-holder in a fixed overhead position, where the handlebar can be used either as an overhead support rest or as a pull-up bar. When the handlebar is in its fixed position, it reverts into a fixed overhead support that can, at anytime, while doing a lower body exercise, be used as a chin-up bar.

The use of the elastic members in combination with the horizontally oriented handlebar provides variable support and the ability to move the handlebar to a variety of different, continuous overhead positions as desired. This type of variable support is fundamental in strengthening core muscles. This configuration also creates two entirely new exercise that were not possible before, that is, assisted or un-assisted pull-ups or dips. This embodiment has only one overhead handlebar that can give vertical support in both a fixed, static, and a non-fixed dynamically variable position. Consequently, using my full body workout method and exercise apparatus there is no need to switch back and forth between two overhead handlebars; one overhead handlebar is used for both fixed and variable overhead support. Therefore, my apparatus is less expensive to manufacture because only one, rigid multipurpose overhead handlebar is needed. Moreover, because of my method's unique and innovative configuration, my exercise apparatus increases efficiency, adds extra exercise positions (both assisted pull-ups and assisted dips), and, thus, adds value not formerly possible.

DESCRIPTION OF THE DRAWING

Some embodiments of my exercise apparatus, kit and method are discussed in detail in connection with the accompanying drawing, which is for illustrative purposes only. This drawing includes the following figures (Figs.), with like numerals and letters indicating like parts:

FIG. 4A is a perspective view of the third embodiment of my exercise apparatus where the handlebar is removed from the rack, is gripped by the user with both hands and pulled to stretch the elastic members.

FIG. 4B is a perspective view of the third embodiment shown in FIG. 4A depicting the user returning the handlebar to its rack;

FIG. 4C is a perspective view of the third embodiment shown in FIG. 4A where the handlebar is in a static position in the rack and is being used as a chin-up bar; and FIG. 4D is a kit that converts an existing lower body exercise machine into the third embodiment of my exercise apparatus in which an attachment assembly comprising a handlebar, elastic members, and a rack are contained, shown assembled and ready to be connected to the lower body exercise machine.

FIG. 5A is a perspective view of the fourth embodiment of my exercise apparatus where the handlebar is removed from the rack and is gripped with both hands of the user to stretch the elastic members; and FIG. 5B is a perspective view of the fourth embodiment of my exercise apparatus showing the handlebar being returned to a static position;

FIG. 5C is a perspective view of the fourth embodiment of my exercise apparatus where the handlebar is in a static position in the holder of the rack and is being used as a pull-up bar;

FIG. 5D is a kit in which the partially disassembled components of the fourth embodiment of my apparatus are contained.

DETAILED DESCRIPTION OF SOME ILLUSTRATIVE EMBODIMENTS

FIGS. 1A Through 1F

As illustrated in FIG. 1, my exercise apparatus 10*a* enables a user to exercise their upper body, lower body, and core muscles simultaneously or individually at the option of the user. The exercise apparatus 10*a* comprises an overhead exercise device 16*a* including a horizontally oriented, elongated, rigid handlebar 20, mounted overhead a lower body exercise machine 14 such as a stair climber machine, beneath the handlebar 20. The non-static handlebar 20 and lower body exercise machine 14 are positioned with respect to each other so the user, while standing on and operating the lower body exercise machine 14, can grasp the handlebar 20 and use it to perform pull-ups off the lower body exercise machine 14. The overhead exercise device 16*a* has elastic members 18 attached to the handlebar 20, so that while standing on and operating the lower body exercise machine 14, the user can, instead of performing pull-ups, perform resistance exercises by gripping the handlebar 20 and stretching the elastic members 18. FIGS. 1A through 1C illustrate using an overhand grip with elastic members 18 attached to the ends of the overhead handlebar 20 and FIGS. 1D through 1F illustrate using an underhand grip with elastic members 18 attached to the overhead handlebar 20 with each elastic member being approximately six inches from the middle of the handlebar 20 and on both sides.

FIG. 2

Figure 1C:
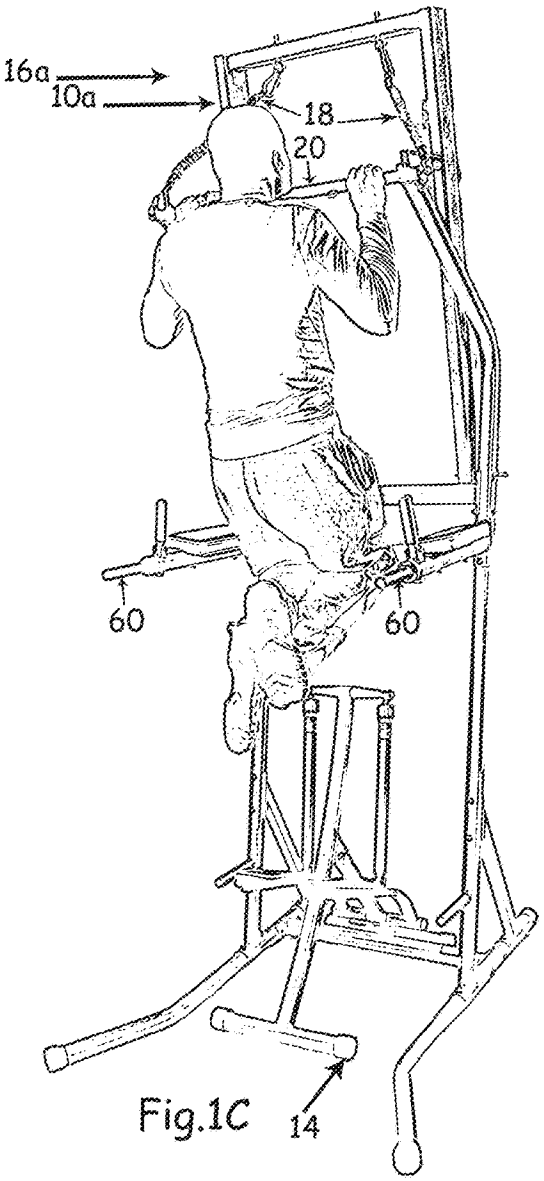
FIGS. 1A through 1C are a series of perspective views depicting a user with an overhand grip on the handlebar and using the embodiment of my exercise apparatus shown in FIG. 4A; with elastic members attached to the ends of the handlebar.
Figure 1B:
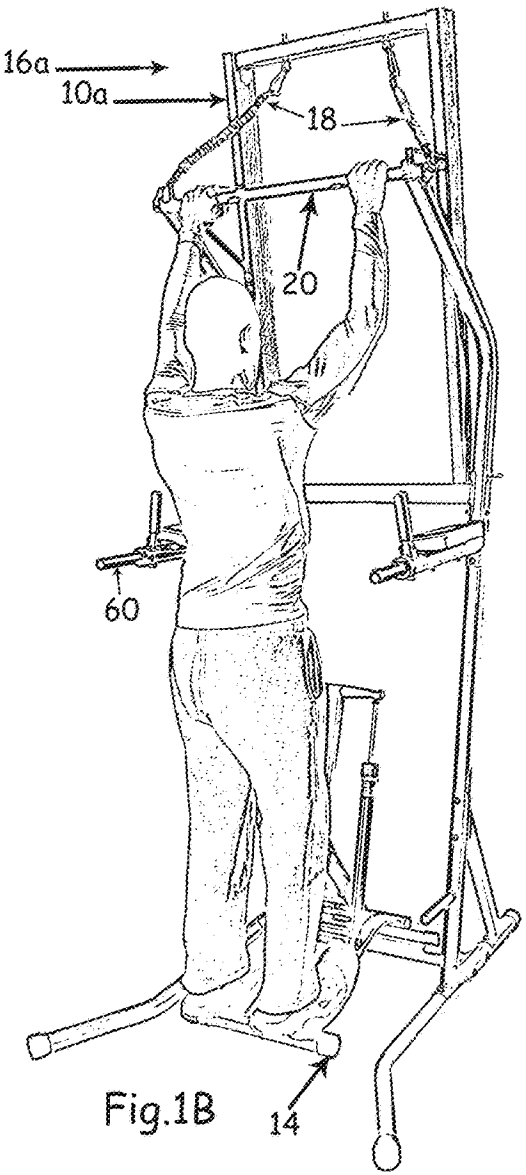
Figure 1A:
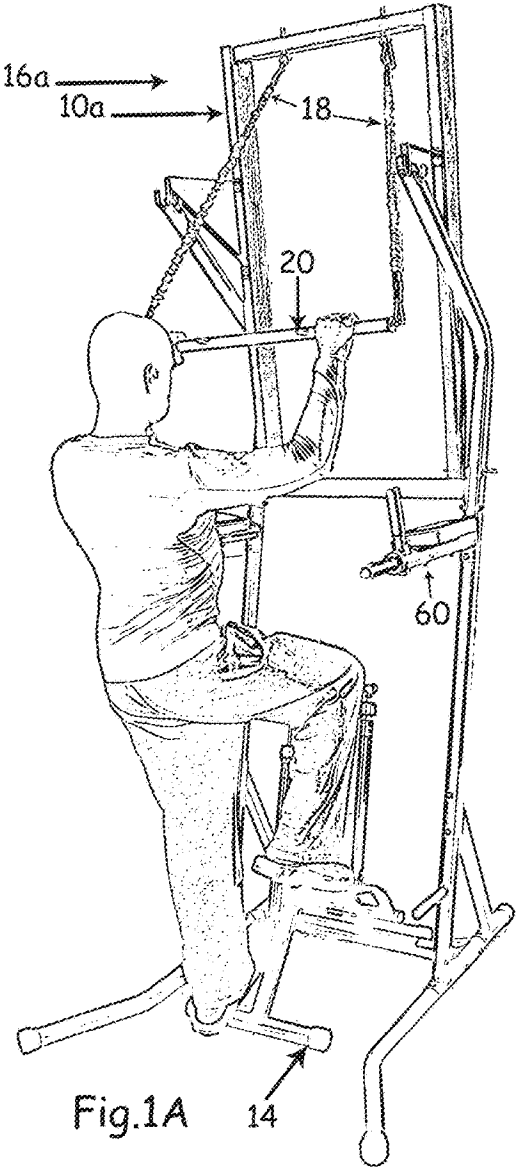
Figure 1F:
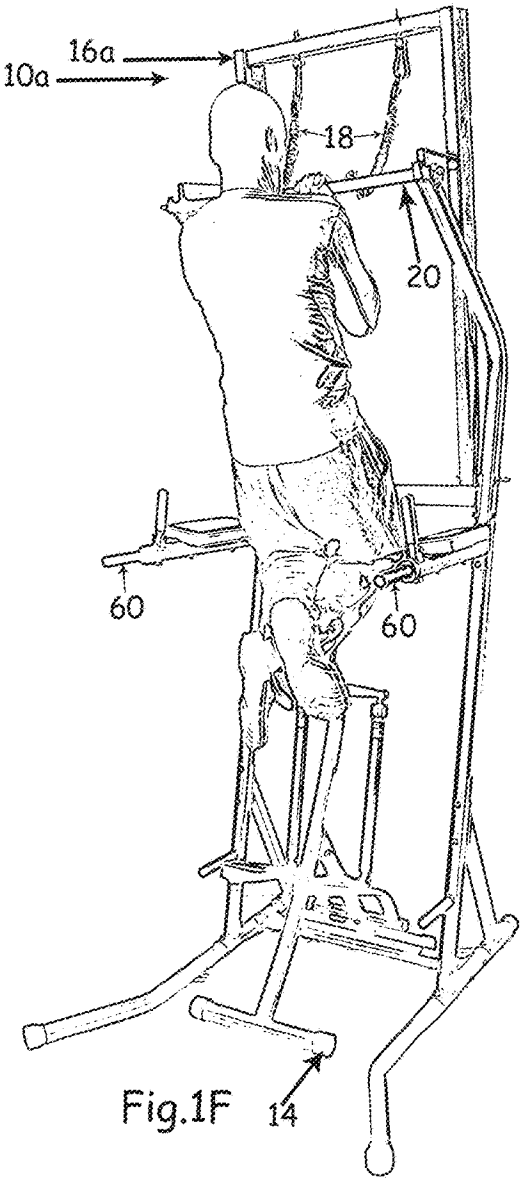
FIGS. 1D through 1F are a series of perspective views depicting a user with an underhand grip on the handlebar and using the embodiment of my exercise apparatus shown in FIG. 4A with the elastic members attached to the handlebar approximately 6 inches from the middle on both sides.
Figure 1E:
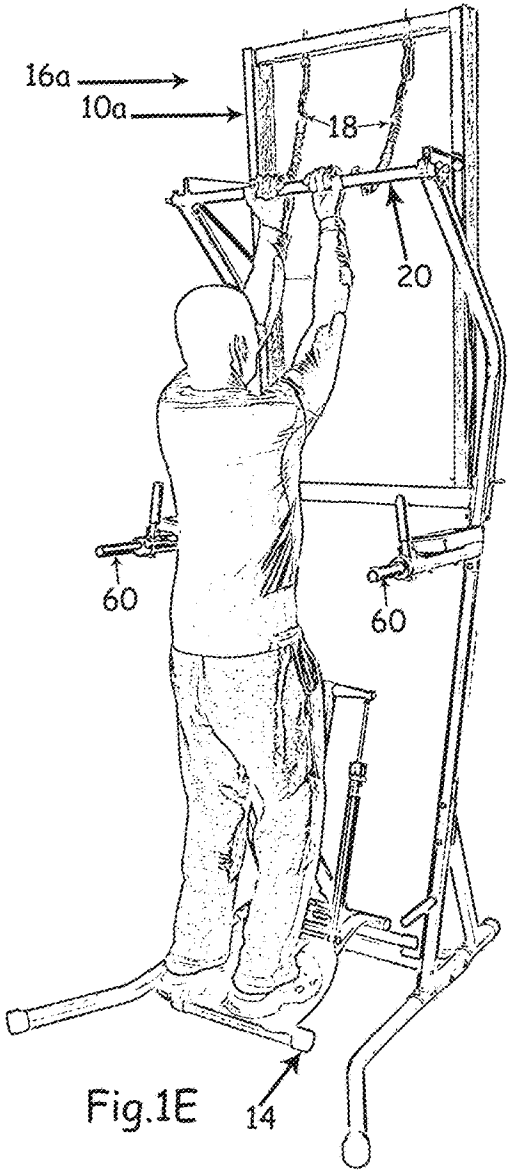
Figure 1D:
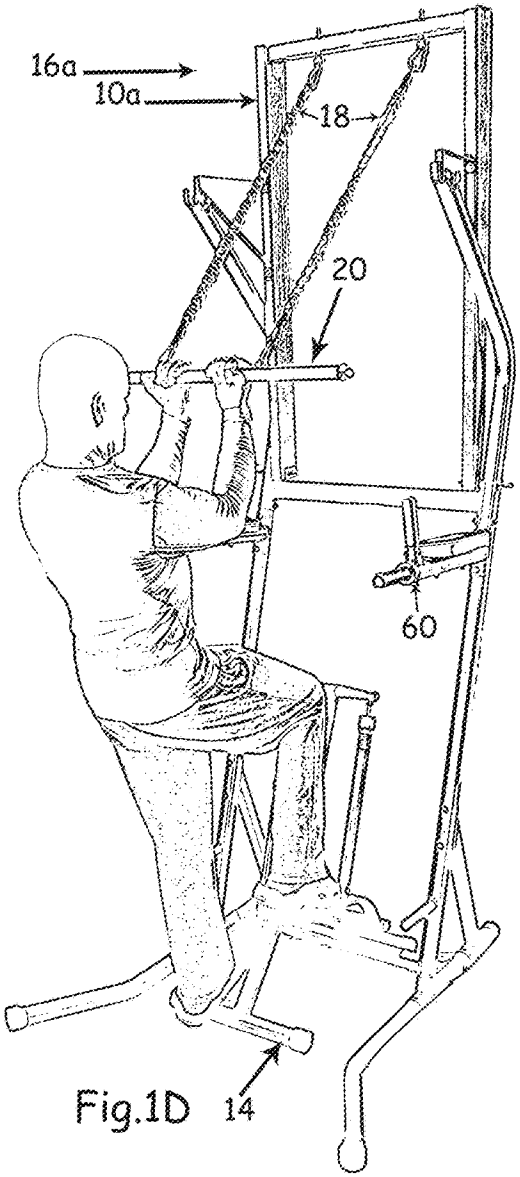
Figure 2:
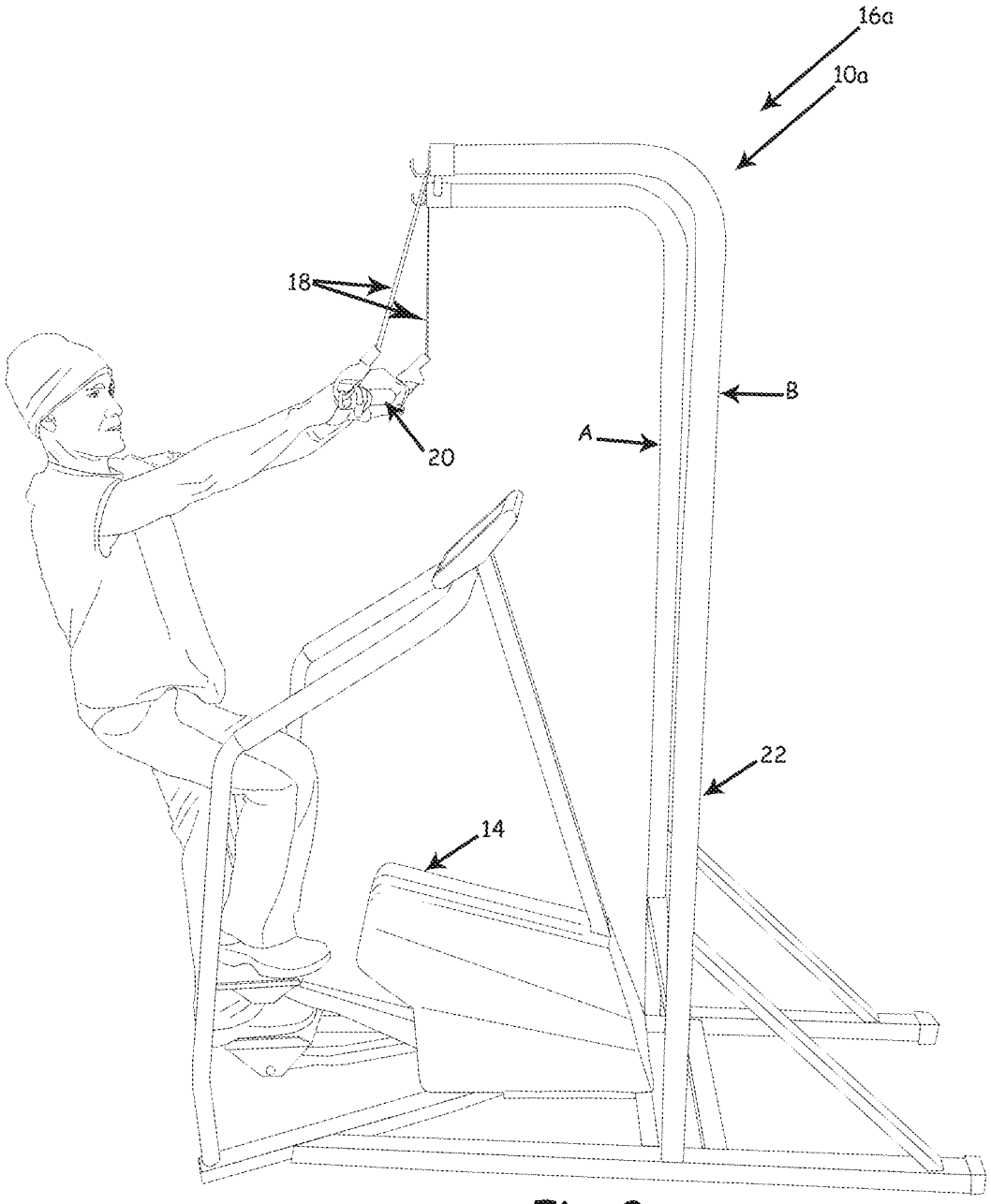
FIG. 2 is a perspective view of one embodiment of my exercise apparatus where a non-static handlebar is mounted to a support structure that has a rack and holder for the handlebar.

As illustrated in FIG. 2, in one embodiment of my exercise apparatus identified by the number 10*a*, the overhead exercise device 16*a* and the lower body exercise machine 14 are connected together by means of a support frame 22. The frame comprises a pair of vertically oriented, parallel, inverted J-shaped posts A and B spaced apart about the width of the lower body exercise machine 14. The non-static exercise handlebar 20 is mounted above the lower body exercise machine 14 and the elastic members 18 comprise a pair of elastic cords; for example, bungee cords. The distal ends of the elastic members 18 are connected individually to the inverted J-shaped posts A and B, and the proximal ends of the members 18 are attached to the opposed ends of the non-static handlebar 20, or alternatively, approximately 6 inches from the center and on both sides of the non-static handlebar 20. The overhead non-static handlebar 20 and the lower body exercise machine 14 are positioned with respect to each other so the user may use both simultaneously.

While standing on and operating the lower body exercise machine 14, and without lifting the user's body up and off the lower body exercise machine 14, the user can operate the overhead exercise device 16*a* by gripping the non-static handlebar 20 and simultaneously pulling and releasing this overhead handlebar 20 towards and away from the user's chest, stretching and lengthening the elastic members 18, placing the elastic members 18 in tension, and then slowly releasing the tension and allowing the elastic members 18 to shorten in length.

FIG. 3

Figure 3:
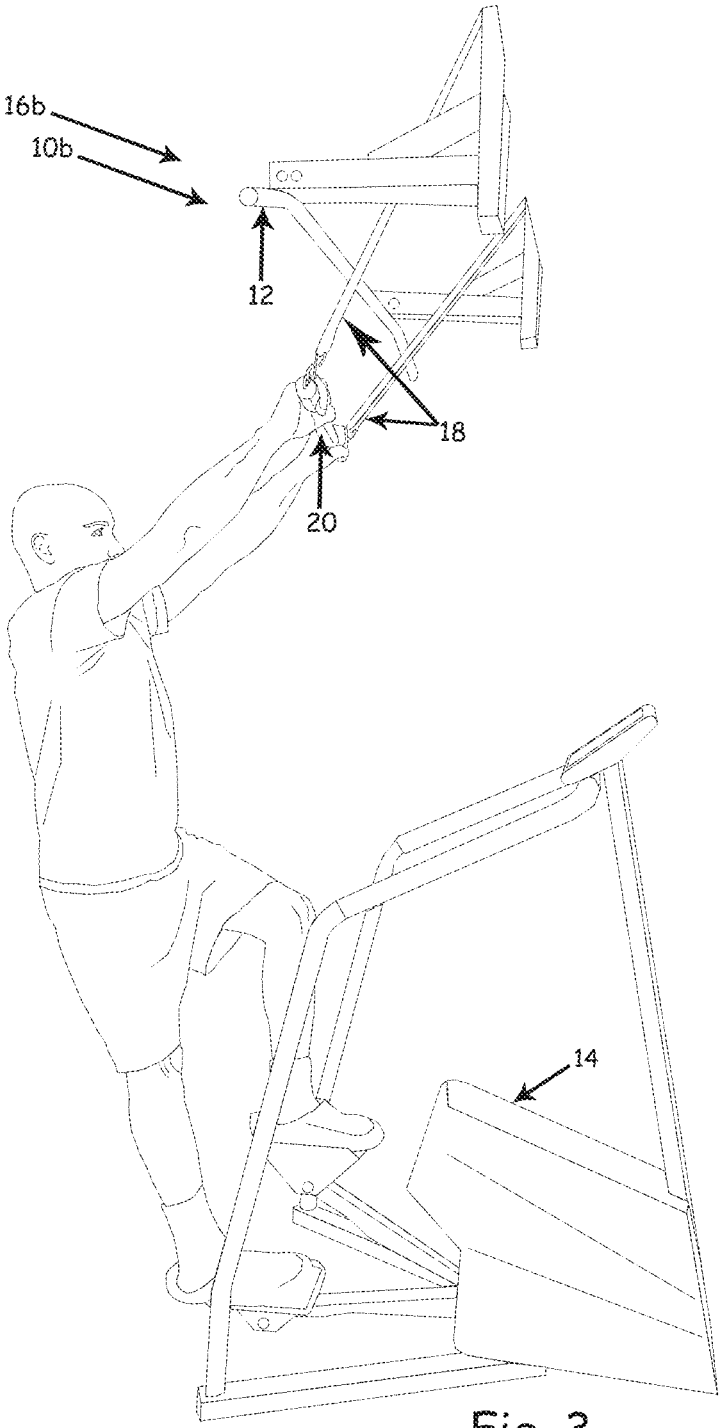
FIG. 3 is a perspective view of a second embodiment of my exercise apparatus where there is both a non-static handlebar and static overhead handlebar that are mounted to a support structure attached to an overhead beam above the lower body exercise machine.

As illustrated in FIG. 3, a second embodiment of my exercise apparatus identified by the number 10*b* includes an overhead exercise device 16*b* comprising of elastic members 18 attached to a horizontally oriented, elongated, rigid, handlebar 20 mounted and positioned overhead non-statically. The elastic members 18, for example, may comprise a pair of elastic bungee cords extending between the opposed ends of the non-static handlebar 20 and a support structure. The overhead exercise device 16*b* and lower body exercise machine 14 are positioned with respect to each other so the user, while standing on and operating the lower body exercise machine 14, and without lifting the body off the lower body exercise machine 14, can grip the non-static handlebar 20 and pull and release to perform resistance exercises. Alternately, the user may do pull-ups using the secondary static handlebar 12.

FIGS. 4A-4H

Figure 4A:
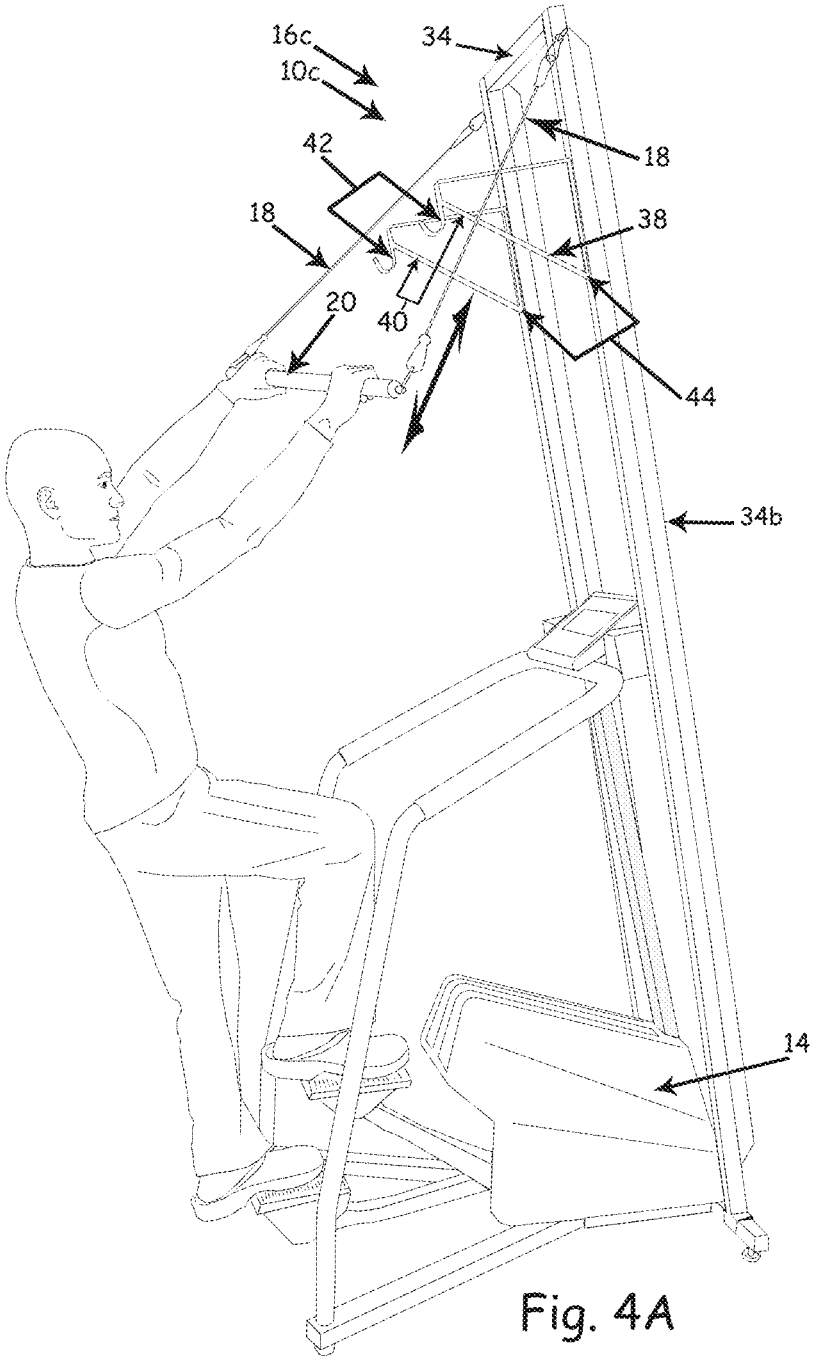
FIGS. 4A through 4D depict a third embodiment of my exercise apparatus including a single handlebar that is movable between static and non-static positions.
Figure 4B:
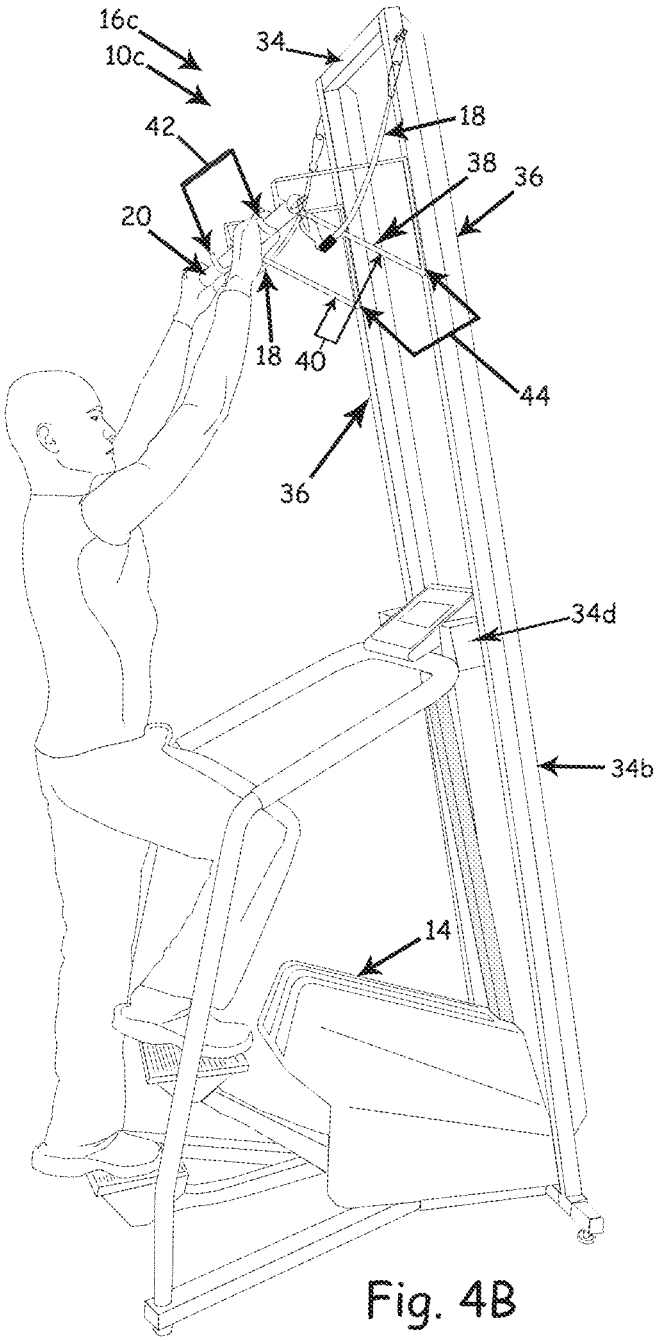
Figure 4C:
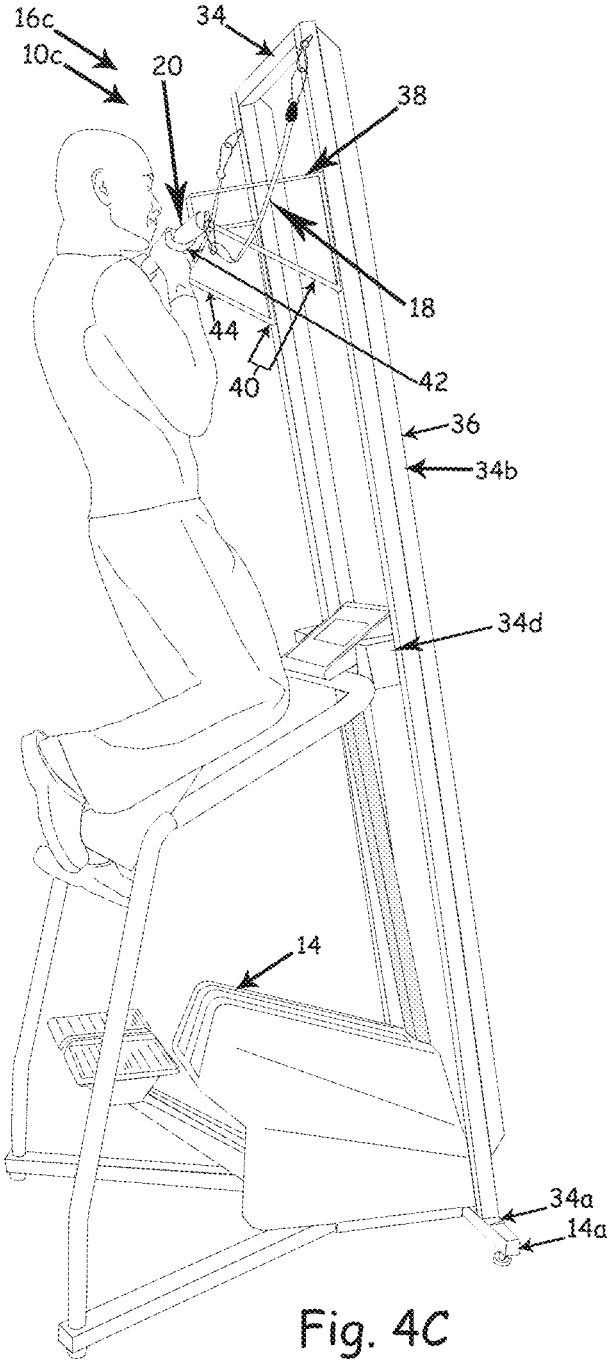

As illustrated in FIGS. 4A through 4H, a third embodiment of my exercise apparatus 10*c*, similar to that depicted in FIGS. 2 and 3, employs an overhead exercise device 16*c* and a pair of elastic members 18. In connection with FIGS. 4A-4C, unlike the embodiment shown in FIG. 3, the handlebar 20 is mounted to enable moving it manually, in a single motion and while exercising the lower body, from a non-static or dynamic position (FIG. 4A) to a static position (FIG. 4B) to do pull-up exercises (FIG. 4C). The elastic members 18 are attached to ends of the handlebar 20. This assembly of elastic members 18 and handlebar 20 is suspended from an overhead support structure to position the handlebar 20 at or above shoulder height of a user standing on the lower body exercise machine 14 with the handlebar 20 in a dynamic position.

Figure 4D:
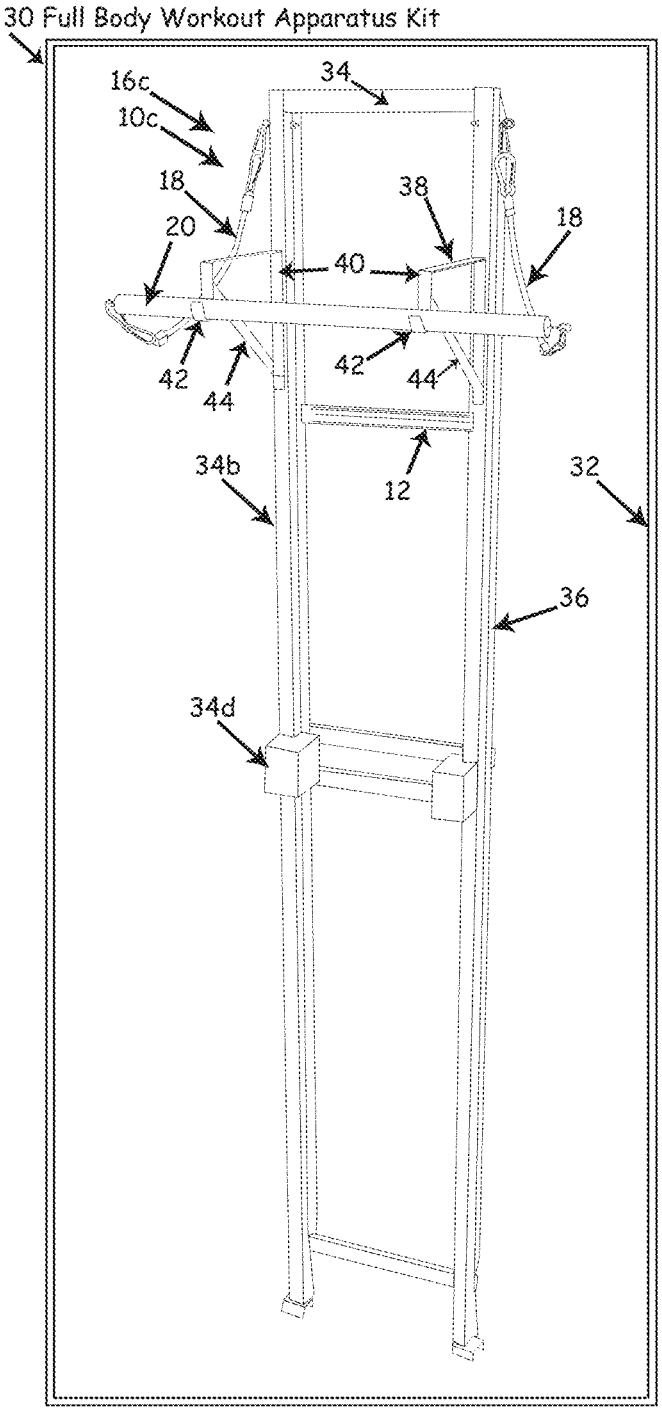

As shown in FIG. 4D, an attachment kit 30 comprises within packaging 32, an attachment 34 for connecting the overhead exercise device 16*c* to a conventional lower body exercise machine 14, the components of which convert a conventional machine 14 into the third embodiment of my apparatus. For example, the packaging 32 may simply comprise a strap wrapped around disassembled components of the attachment 34, or the disassembled components may be within a plastic wrap or cardboard box. The attachment 34 consists of a rigid rectangular support frame member 36 that extends upward and terminates at an upper end which is attached to an overhead rack 38 for the handlebar 20, consisting of a holder 40 for the handlebar 20 that enables a user to lift up to remove the handlebar 20 from the rack. The holder 40 may comprise, for example, a pair of aligned J-clevises 42. The handlebar 20 rests on a rack and holder 38 in a horizontal orientation. Each end of the handlebar 20 is attached to elastic members 18 that are attached to the frame 36; alternatively each elastic member 18 can also be attached to the handlebar 20 approximately six inches from the middle of the handlebar 20, on both sides.

The rack 38 employed in all the embodiments is the same. It comprises a pair of metallic triangle components 44 that are identical in shape and size. Each triangle component 44 is a rigid structure. When mounted, the pair of metallic triangle components 44 forms a vertical base member. At the upper end of the base member 44, a horizontal member extends outward at a right angle to the base member 44, and a slanting brace member terminates at its outer end in one of the J-shaped open devises 42. The handlebar 20 rests in the pair of J-shaped open devises 42. The J-shaped open devises 42 in each of the triangle components 44 are aligned so, when the handlebar 20 is in the static position, it is horizontal.

This arrangement allows the user to simply push upward on the handlebar 20 to remove it from the rack and holder 38 so the handlebar 20 can become dynamic but still give the user vertical support. The user returns the handlebar 20 to the static position by simply placing the handlebar 20 in the aligned pair of J-shaped open devises 42. The lower body exercise machine 14 and handlebar 20 in the rack and holder 38 are positioned with respect to each other so the user, while standing on and operating the lower body exercise machine 14, can alternately: As depicted in FIG. 4C, grasp the handlebar 20 and raise their body up and off the lower body exercise machine 14 to perform pull-ups; or, as depicted in FIG. 4A, remove the handlebar 20 from the rack and grip it with both hands to pull the handlebar 20 towards the user's chest, which enables the elastic members 18 to be stretched and released; thus placing the elastic members 18 in tension and then slowly releasing the tension providing the user with an upper body and core muscle strengthening exercise.

Figure 4E:
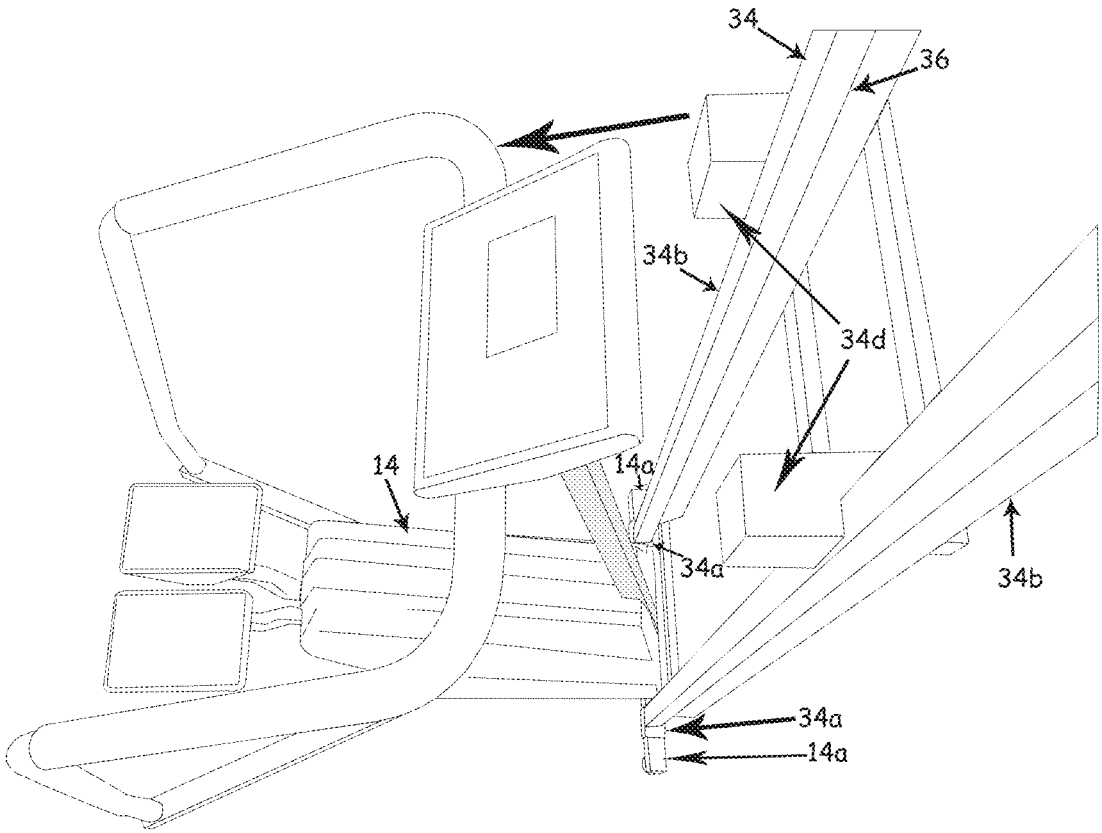
FIG. 4E is a bird's eye view illustrating how the attachment assembly shown in FIG. 4D is connected to a conventional lower body exercising machine to build the third embodiment of my exercise apparatus.
Figure 4F:
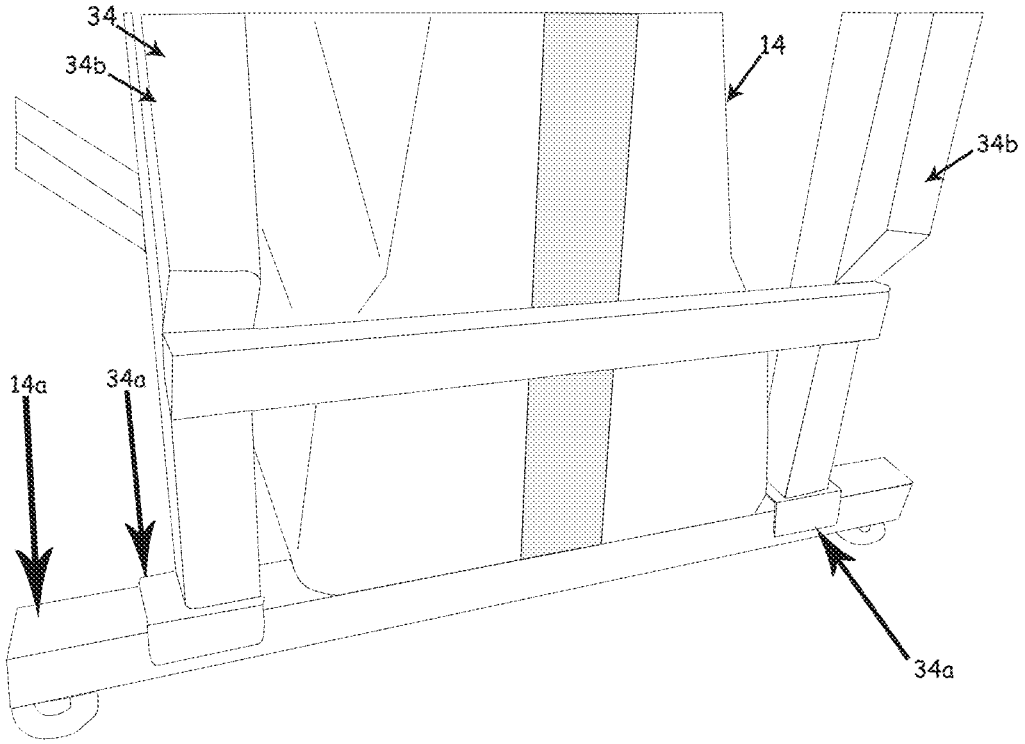
FIG. 4F is a perspective view illustrating clips at the feet of the attachment to connect it to a lower horizontal frame element of the conventional lower body exercise machine.
Figure 4G:
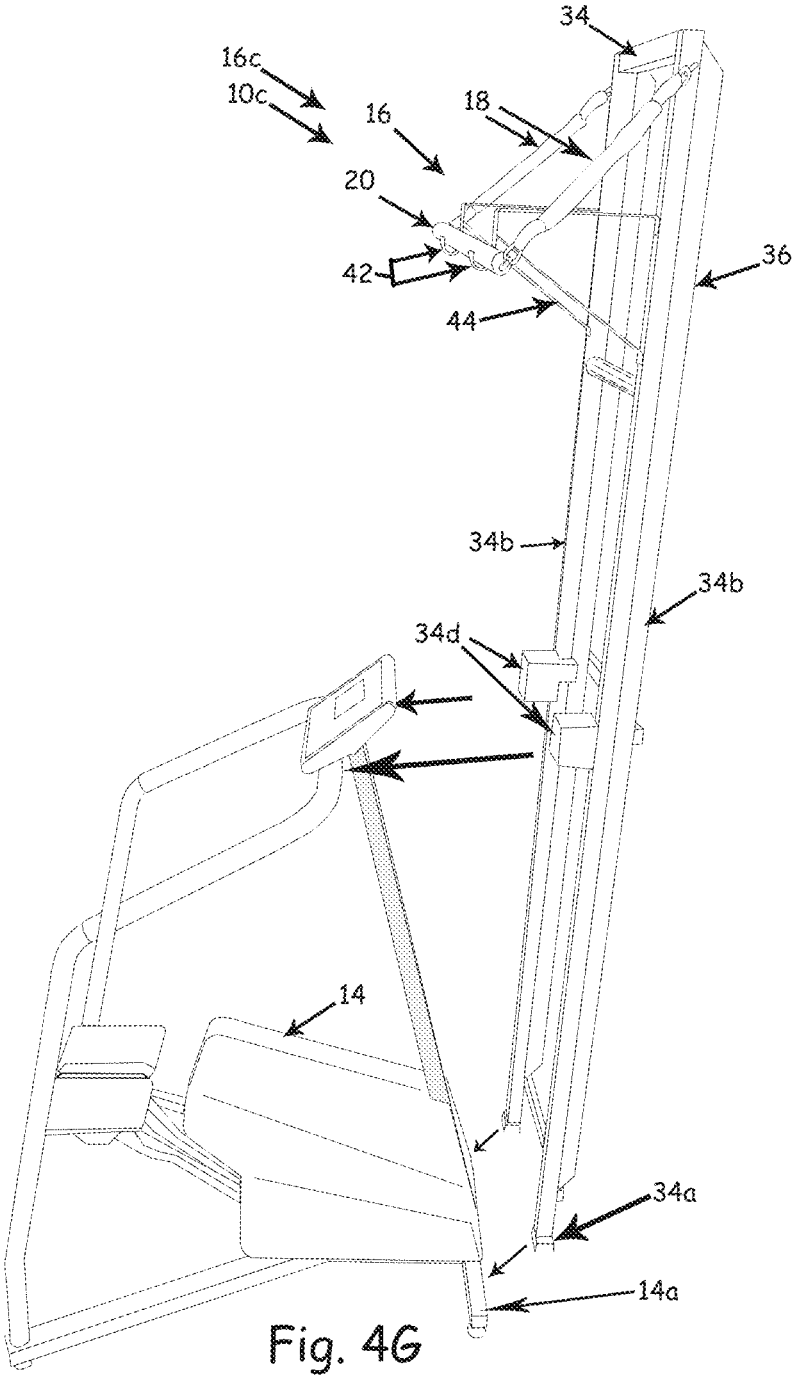
FIG. 4G is a side perspective showing the attachment being mounted to the conventional lower body exercise machine and abutted to a horizontal portion of a handrail of the lower body exercise machine.
Figure 4H:
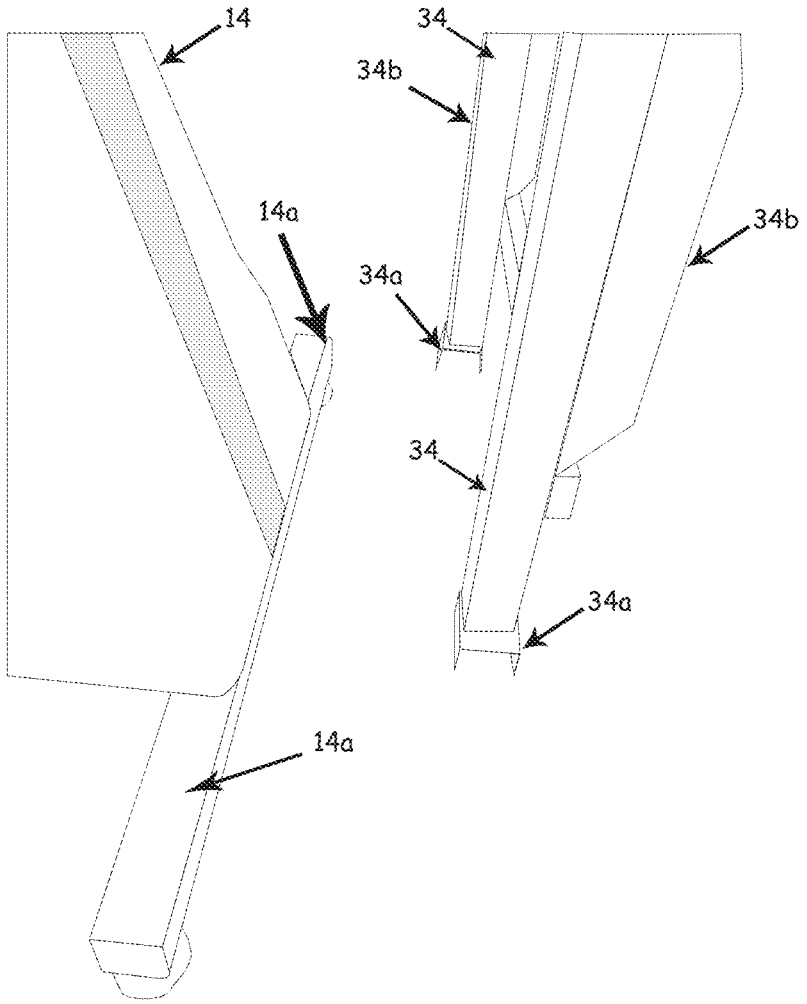
FIG. 4H is a perspective view showing the clips being snapped onto the lower frame element of the conventional lower body exercising machine.

FIGS. 4E through 4H illustrate one way of connecting the attachment 34 to a pre-existing lower body exercise machine 14. The attachment 34 has inverted U-shaped clips 34*a* on the bottom of each one of a pair of parallel rail members 34*b*. The clips 34*a* fit over and snap onto a bottom, horizontal frame element 14*a* of the existing lower body exercise machine 14 as depicted in FIGS. 4E and 4F. The attachment 34, positioned at an acute angle, leans towards the user while the user operates the lower body exercise machine 14. Along each rail 34*b* of the attachment, approximately at each rail's midsection, is a bumper 34*d*. Attached between the rails 34*b* is a fixed horizontal handlebar 12 for added user support.

FIGS. 5 and 5A-5D

Figure 5:
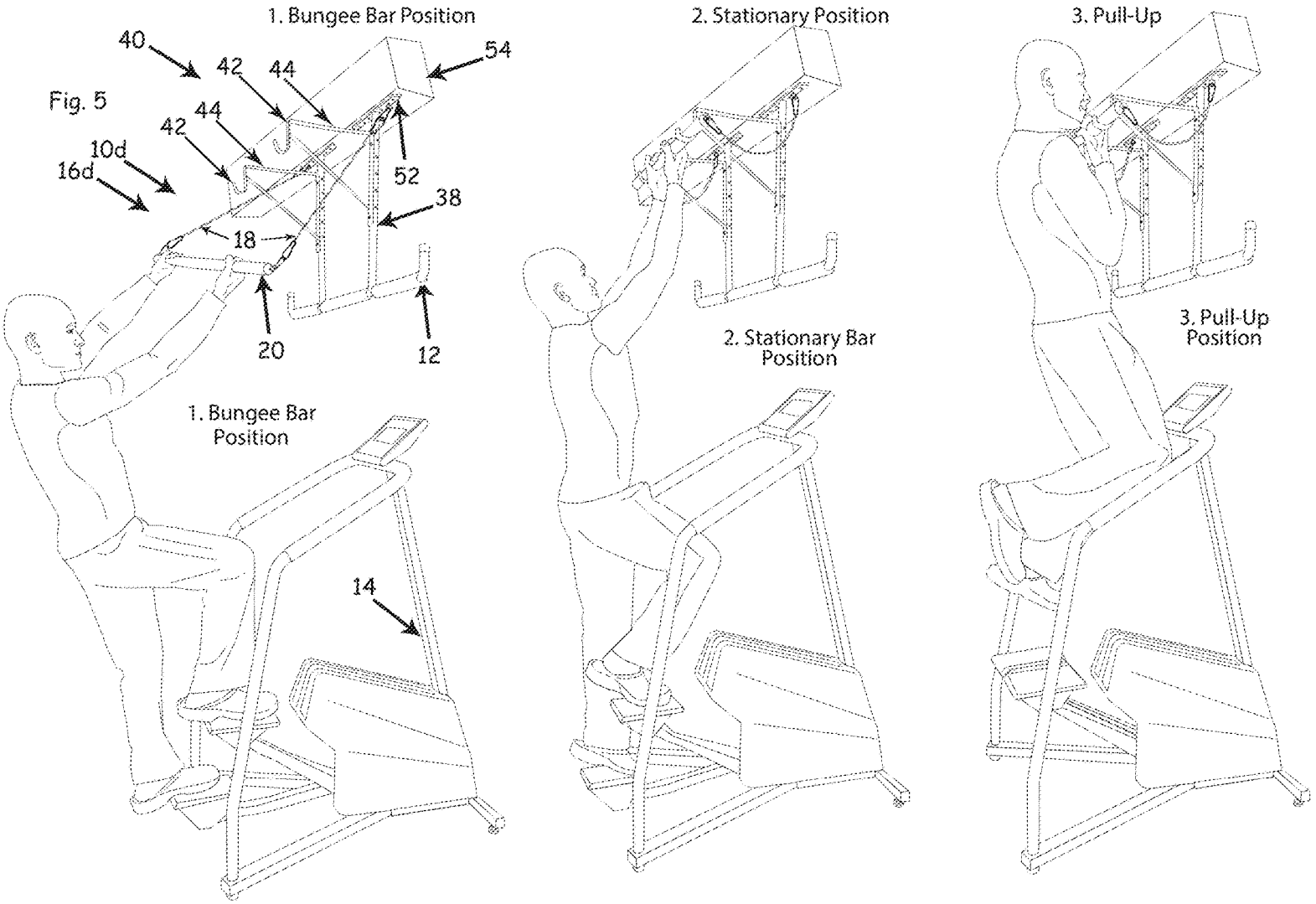
FIG. 5 is a perspective view of the progression of a pull-up in one handgrip and motion, where the user starts with the dynamic handlebar attached to elastic members and, in one motion, moves the handlebar to an elevated, stationary position above the user's head to place it in a holder on a rack that can carry the weight of the user and enable pull-ups.
Figure 5A:
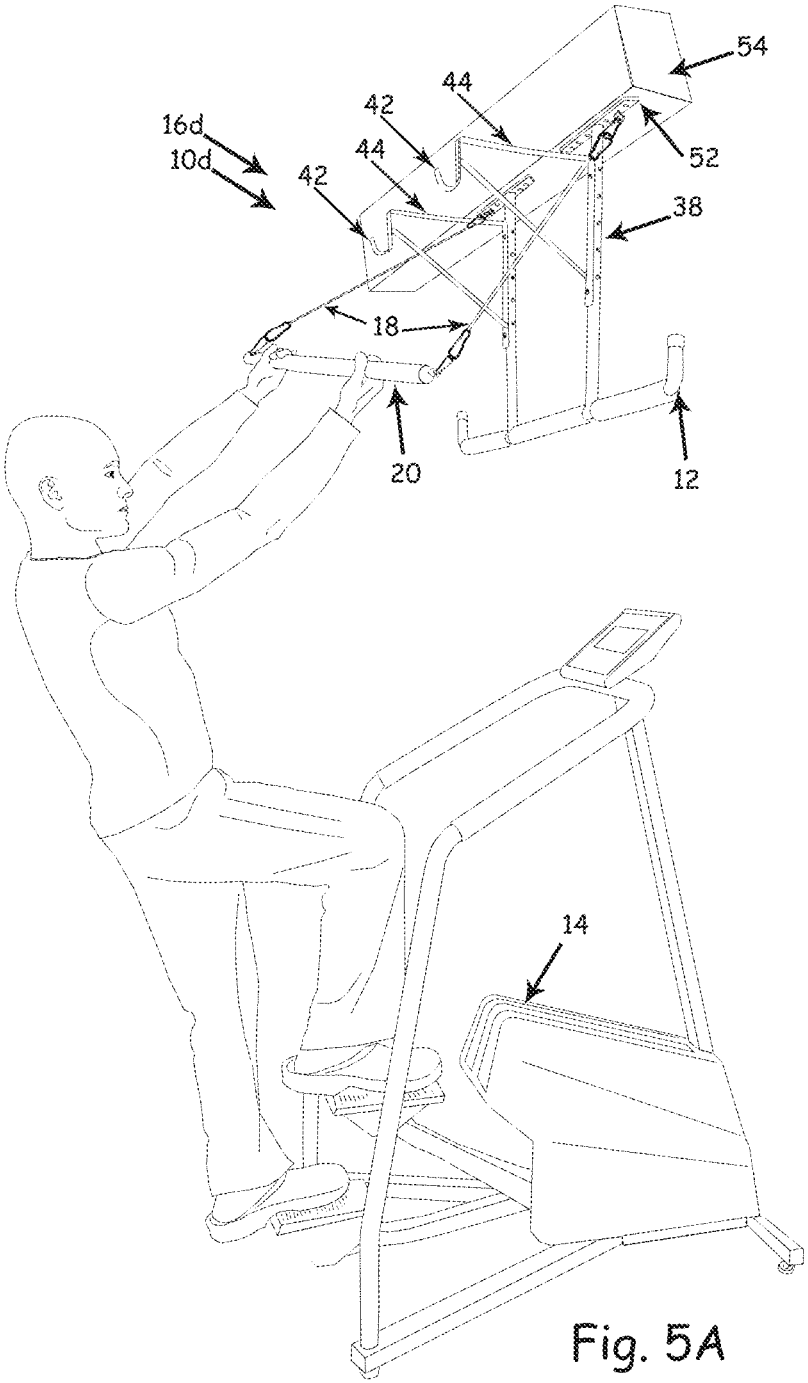
FIGS. 5A through 5D depict a fourth embodiment of my exercise apparatus including a handlebar movable between static and non-static positions and a support member adapted to be mounted to an overhead beam, where.
Figure 5B:
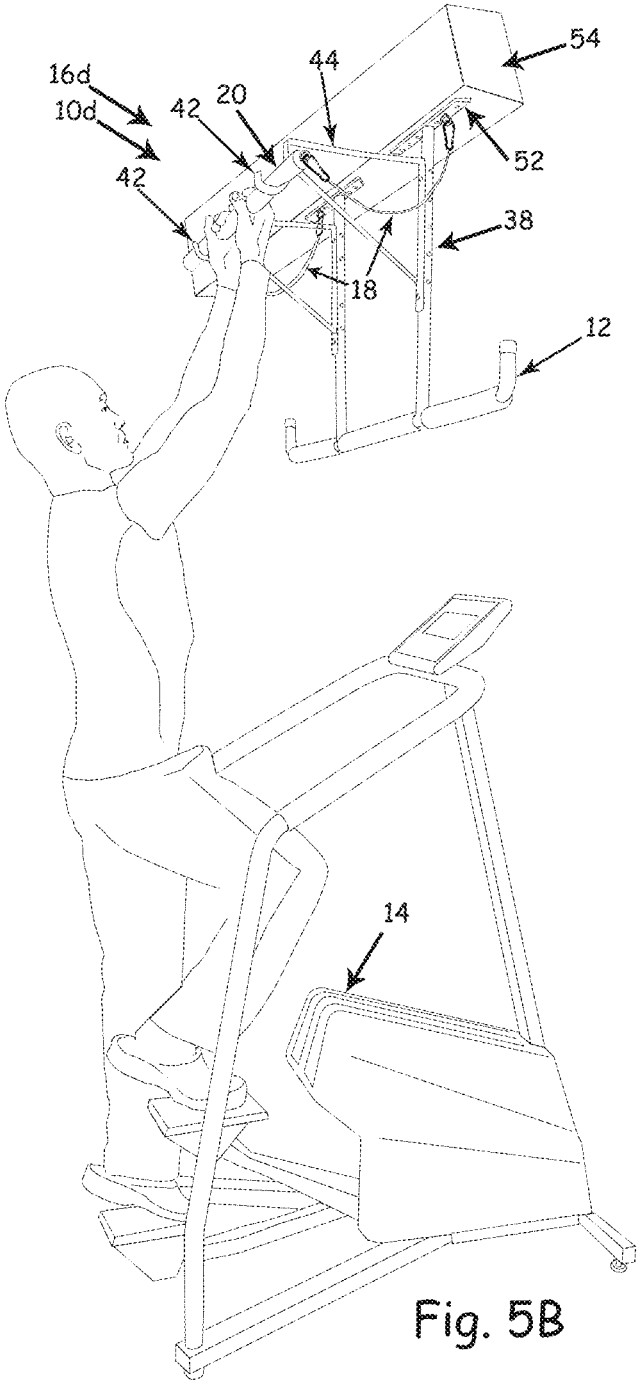
Figure 5C:
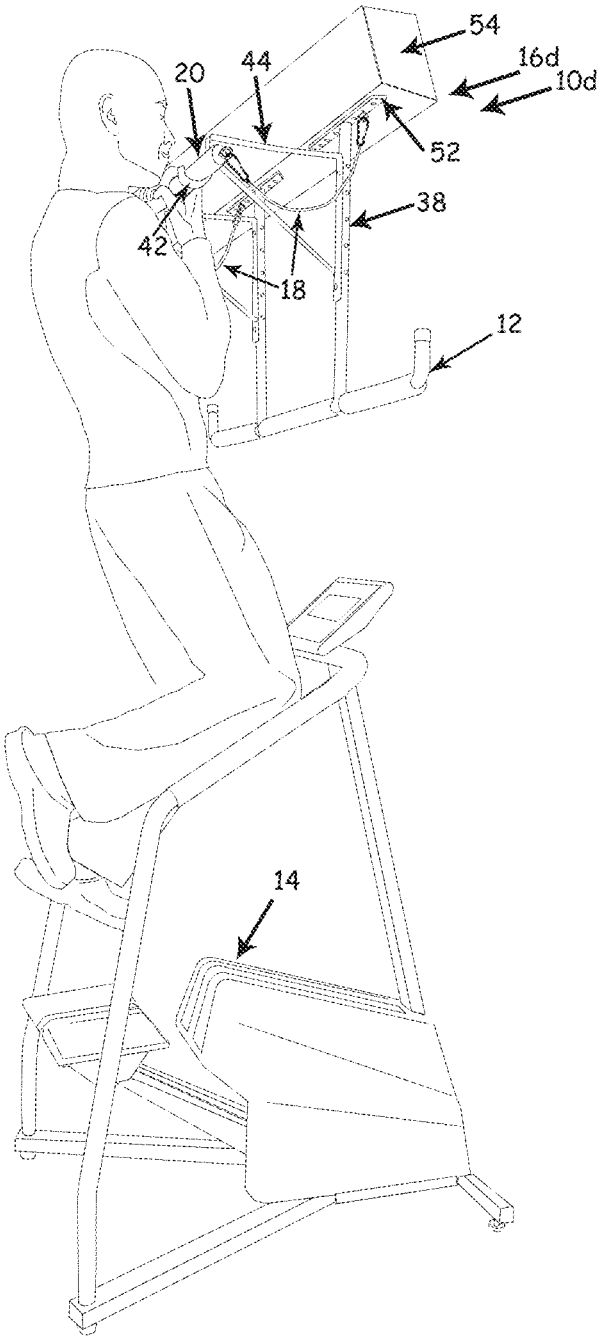

In this fourth embodiment, 10*d*, the overhead exercise device 16*d* and lower body exercise machine 14 are disconnected, and the non-static overhead handlebar 20 of the overhead exercise device 16*d* has connected to its opposed ends the proximal ends of the elastic members 18. The distal ends of the elastic members 18 are fixed to an overhead rack that can then be fastened to the ceiling or, as depicted in FIG. 5, an overhead beam 54. The handlebar 20 rests in a pair of aligned J-clevises 42 as a holder. This holder 40 enables the user, with arms extended upward, to lift the handlebar 20 from the holder 40 and stretch the elastic members 18, which transfers the handlebar 20 from a static to a non-static position in a single motion. In the non-static handlebar position (FIG. 5A), the user is able with arms extended over the user's head, to pull on the handlebar 20 towards the user to extend the elastic members 18; thus enabling the user to operate the overhead exercise device 16*e* while exercising their lower body. At will, and, in one motion, the user may then switch the handlebar 20 to the overhead stationary, static position, enabling the user with arms outstretched and elevated over the user's head, to support the user vertically or optionally do a pull-up exercise (FIG. 5C).

Figure 5D:
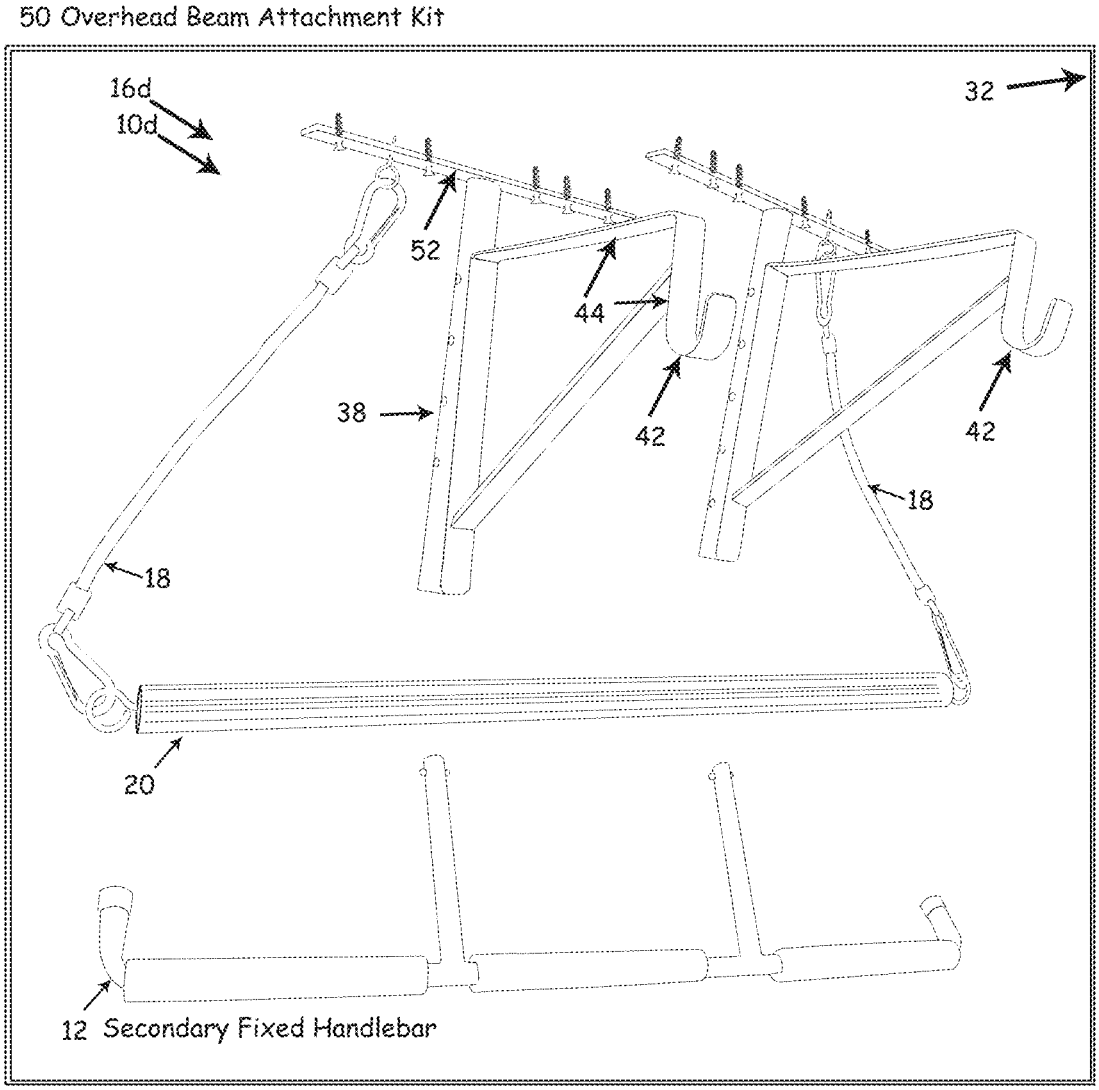

As illustrated in FIGS. 5A through 5D, my exercise apparatus 10*d*, utilizes an overhead elastic-resistance exercise device 16*d* similar to that depicted in FIGS. 2, 3 and 4. However, instead of using a support frame 36 provided by the support frame attachment kit 30, that is to be attached to the lower body exercise machine 14, an overhead beam attachment kit 50 is depicted in FIG. 5D that employs an elastic-resistance exercise device 16*d* that is mounted on a frame support 52 that is fastened to the ceiling or, as depicted in FIG. 5, an overhead beam 54. This kit 50 consists of a rack 38 to which a triangle component 44 is attached. The assembly rack 38 and attached triangle component 44 is mounted to the ceiling or overhead beam 54 so the overhead, upper body exercise device 16*d* is in an elevated position above the user while the user is standing upright on the lower body exercise machine 14.

Figure 6:
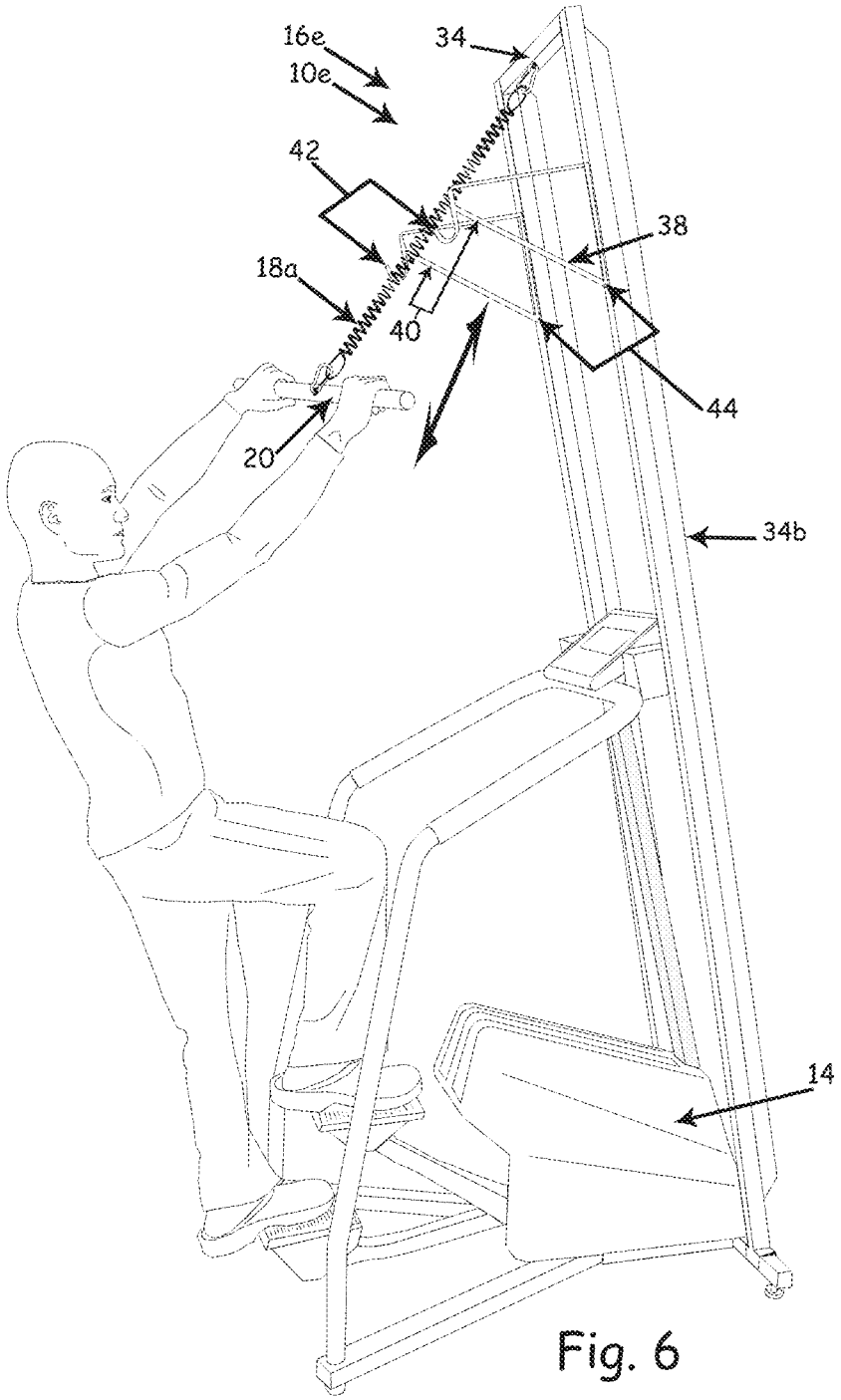
FIG. 6 is a perspective view of a fifth embodiment of my exercise apparatus where the handlebar uses only one elastic member such as bungee cord or spring as shown.

FIG. 6 is a perspective view of a fifth embodiment of my exercise apparatus 10*e*, similar to that depicted in FIGS. 2 and 3, which includes an overhead exercise device 16*e* comprising of a single elastic member 18*a*, such as a spring, attached to a horizontally oriented, elongated, rigid, handlebar 20.

Figure 7:
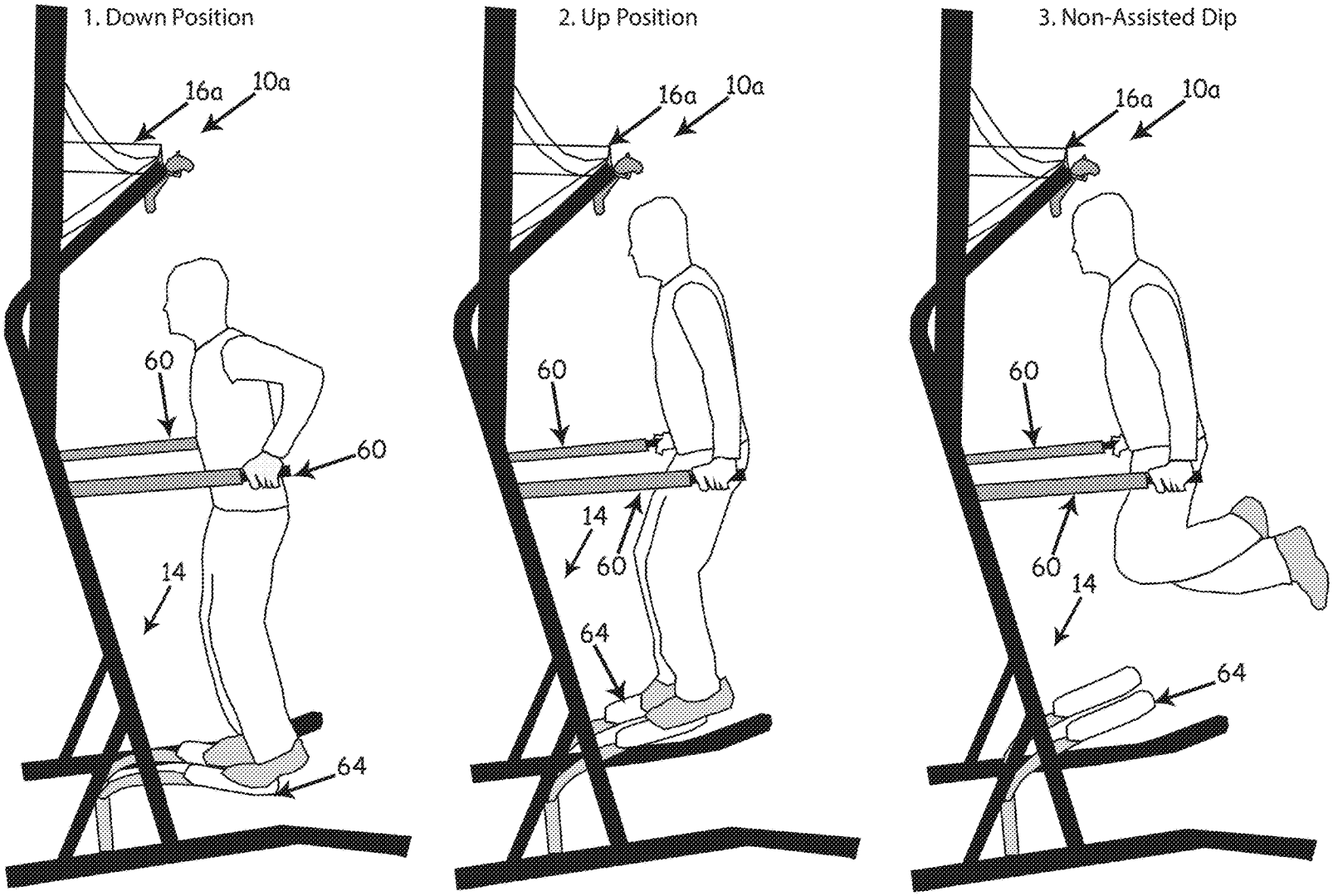
FIG. 7 is a perspective view of the progression of a dip exercise, where the user places their hands on horizontal handgrips.

As illustrated in FIG. 7, the lower portion 14 of the exercise apparatus 10*a* includes a pair of opposed hand supports 60 at the same vertical elevation. These opposed hand supports 60 enable a user to do a dip exercise, whereby the user rests or grips the hand supports and simultaneously lowers and raises his/her body in a vertical plane. The user can perform the dip exercise either an un-assisted traditional dip exercise, or optionally using the lower body exercise machine 14 for assistance and support while performing a dip exercise.

Lower body exercise machine 14 illustrate " . . . means for exercising an individual's lower body . . . " As discussed above, such means include a stationary bike, stair climber, elliptical trainer, arc trainer and treadmill. These machines only strengthen the lower body muscles with little to no upper body or core muscle strengthening . . ."

Overhead exercise devices 16*a* through 16*e* illustrate " . . . means for exercising . . . upper body. FIGS. 1A through 5C illustrate " . . . means for positioning the handlebar with respect to the lower body exercise machine to enable the user to either lift the user's body up and off the lower body exercise machine to do a pull-up or without lifting the users body up and off the lower body exercise machine using the lower body exercise machine as lower leg support to do an assisted pull-up.

SCOPE OF THE INVENTION

The above presents a description of the best mode I can contemplate for implementing my exercise apparatus, kit, and method and of the manner and process of making and using them, in such full, clear, concise, and exact terms as to enable a person skilled in the art to make and use. My exercise apparatus, kit and method, however, are susceptible to modifications and alternate constructions from the illustrative embodiments discussed above, however, which are possible and fully equivalent. Consequently, it is not the intention to limit my exercise apparatus, kit, and method to the particular embodiments disclosed. On the contrary, my intention is to cover all modifications and alternate constructions coming within the spirit and scope of my exercise apparatus, kit, and method as generally expressed by the following claims, which particularly point out and distinctly claim the subject matter of my invention:

The invention claimed is:

1. A method of concurrently exercising the lower body, upper body and core muscles simultaneously or individually at the option of the user, said method comprising: the steps of (a) exercising the lower body by standing on a lower body exercise machine and with the user's arms outstretched grasping a horizontally oriented handlebar above the head of the user that is within user's reach, and (b) exercising the upper body and core muscles by the user pulling on the handlebar with both hands while gripping the handlebar, where the handlebar is detachable and connected by an elastic member to a support structure, and is alternately moved between a static position with the handlebar in a rack and a dynamic position with the handlebar removed from the rack.

2. The method of claim 1 where the handlebar in the static position is used to do a pull up motion while standing on or lifting off of the lower body exercise machine.

3. An exercise apparatus enabling a user to exercise upper body, lower body and core muscles, said apparatus comprising a lower body exercise machine beneath an overhead handlebar, an elastic member attached to the handlebar that lengthens upon being stretched, said handlebar being mounted to be alternately moved between a static position with the handlebar in a rack and a dynamic position with the handlebar removed from the rack to enable the user to stretch the elastic member, said rack being suspended from an overhead support structure to position the handlebar at or above shoulder height of the user standing on the lower body exercise machine with the handlebar in the dynamic position, and said overhead handlebar and lower body exercise machine configured with respect to each other so the user, while standing on and operating the lower body exercise machine, can grasp the handlebar and lift the user's body up and off the lower body exercise machine, enabling the user to either lift the user's body up and off the lower body exercise machine to do a pull-up or without lifting the users body up and off the lower body exercise machine using the lower body exercise machine as lower leg support to do an assisted pull-up.

* * * * *